US007556972B2

(12) United States Patent
Balachandran et al.

(10) Patent No.: US 7,556,972 B2
(45) Date of Patent: Jul. 7, 2009

(54) DETECTION AND CHARACTERIZATION OF SICOH-BASED DIELECTRIC MATERIALS DURING DEVICE FABRICATION

(75) Inventors: Manoj Balachandran, Wappingers Falls, NY (US); James A. Hagan, Hopewell Junction, NY (US); Ben Kim, Wappingers Falls, NY (US); Deoram Persaud, Bronx, NY (US); Adam D. Ticknor, Poughquag, NY (US); Wei-tsu Tseng, Hopewell Junction, NY (US)

(73) Assignee: International Business Machines Corporation, Armonk, NY (US)

( * ) Notice: Subject to any disclaimer, the term of this patent is extended or adjusted under 35 U.S.C. 154(b) by 37 days.

(21) Appl. No.: 11/626,975

(22) Filed: Jan. 25, 2007

(65) Prior Publication Data

US 2008/0182335 A1 Jul. 31, 2008

(51) Int. Cl.

| | |
|---|---|
| ***G01R 31/26*** | (2006.01) |
| *H01L 21/00* | (2006.01) |
| *H01L 21/302* | (2006.01) |

(52) U.S. Cl. ..... 438/14; 438/7; 438/8; 438/690; 438/691; 438/692; 257/E21.304; 257/E21.26; 257/E21.24

(58) Field of Classification Search ..... 438/690–692, 438/745, 747, 7–8, 14; 257/E21.304, E21.26, 257/E21.24

See application file for complete search history.

(56) References Cited

U.S. PATENT DOCUMENTS

| | | | | |
|---|---|---|---|---|
| 5,656,555 | A * | 8/1997 | Cho | 438/760 |
| 6,323,046 | B1 * | 11/2001 | Agarwal | 438/8 |
| 2004/0074517 | A1 * | 4/2004 | Korthuis et al. | 134/1.3 |
| 2007/0251869 | A1 * | 11/2007 | Chen | 210/198.2 |

OTHER PUBLICATIONS

Dionex industry brief, "Analysis of Copper Plating Baths," 1999, IEEE/CPMT Int'l Electronic Manufacturing Techynology Symposium, pp. 203-206.*

Article entitled "A Guide to Silane Solutions from Dow Corning"; 2005, www.dowcorning.com; pp. 1-33.

* cited by examiner

*Primary Examiner*—Alexander G Ghyka
*Assistant Examiner*—Leonard Chang
(74) *Attorney, Agent, or Firm*—Cantor Colburn LLP; Rosa Yaghmour

(57) ABSTRACT

Processes and apparatuses are disclosed for detecting and characterizing SiCOH-based dielectric materials during integrated circuit fabrication. The processes generally include chromatographically analyzing a fluid stream generated during a process employed for device fabrication, e.g., during a wet strip, a chemical mechanical planarization process and the like.

8 Claims, 1 Drawing Sheet

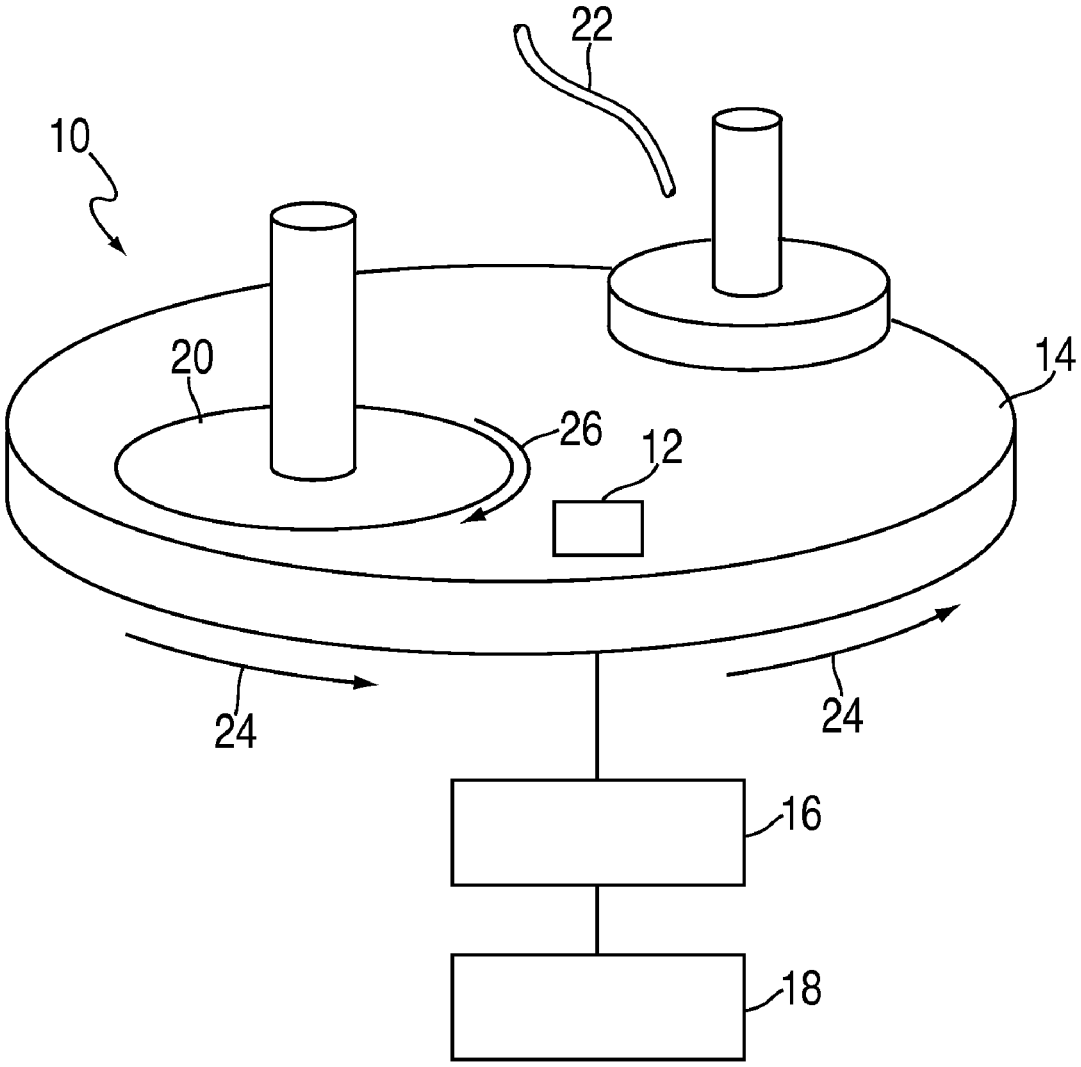
22
10
20
14
26
12
24
24
16
18

DETECTION AND CHARACTERIZATION OF SICOH-BASED DIELECTRIC MATERIALS DURING DEVICE FABRICATION

TRADEMARKS

IBM® is a registered trademark of International Business Machines Corporation, Armonk, N.Y., U.S.A. Other names used herein may be registered trademarks, trademarks or product names of International Business Machines Corporation or other companies.

BACKGROUND OF THE INVENTION

1. Field of the Invention

This invention relates to detection and characterization of SiCOH based dielectric materials during device fabrication, and particularly to the use of chromatography as a means for the detection and characterization.

2. Description of Background

SiCOH low k and ultra low k dielectric materials, also collectively referred to as carbon doped oxide materials or organosilicate glass (OSG), have been implemented in microelectronic devices as low permittivity materials to reduce delay in circuit speed due to capacitance effects. The detection and characterization (e.g., for determining process end point) of SiCOH during processing is critical to speed and reliability performance of the semiconductor devices that are fabricated using this material. The detection and characterization of SiCOH, however, is difficult and non-trivial due to the chemical and structural similarity between SiCOH based dielectrics and more traditional oxide materials such as silicon oxides, fluorinated oxides, silicon nitrides, and the like. In addition, the resolution of conventional characterization techniques such as FTIR, XPS, EDX, and SIMS is not enough to differentiate the subtle chemical and structural changes among the different SiCOH materials. In fact, the detection or endpoint techniques currently available are generally not applicable to device fabrication processes such as chemical mechanical polishing (CMP) or wet strip.

Accordingly, there is a need for improved detection and characterization processes especially as it relates to endpoint detection in CMP and wet strip processes.

SUMMARY OF THE INVENTION

The shortcomings of the prior art are overcome and additional advantages are provided through the provision of a process for detecting and characterizing the presence of a SiCOH dielectric material in a fluid stream that comprises exposing a partially fabricated integrated circuit to a fluid stream, wherein the partially fabricated integrated circuit comprises the SiCOH dielectric material; and chromatographically analyzing the fluid stream for the SiCOH material and derivates thereof.

In another embodiment, a chemical mechanical polishing apparatus comprises a rotatable platen comprising a sample port in fluid communication with a polishing surface, wherein the sample port is downstream and proximate to a wafer location; and a chromatographic apparatus comprising a stationary phase and a detector coupled to the sample port for receiving a fluid stream and configured to analyze SiCOH dielectric material contained within the fluid stream.

Additional features and advantages are realized through the techniques of the present invention. Other embodiments and aspects of the invention are described in detail herein and are considered a part of the claimed invention. For a better understanding of the invention with advantages and features, refer to the description and to the drawings.

As a result of the summarized invention, technically we have achieved a solution for detecting and characterizing SiCOH based materials during the device fabrication process. Although specific reference has been made to wet strip and CMP, it is not intended to be limited and can be implemented and used during various processes specific to device manufacture where a fluid stream is used and/or generated during the fabrication process.

BRIEF DESCRIPTION OF THE DRAWINGS

The subject matter, which is regarded as the invention, is particularly pointed out and distinctly claimed in the claims at the conclusion of the specification. The foregoing and other objects, features, and advantages of the invention are apparent from the following detailed description taken in conjunction with the accompanying drawing in which:

The FIGURE schematically illustrates a chemical mechanical polisher having therein a sampling port embedded within a polishing platen and fluidly coupled to a chromatographic apparatus for detecting and characterizing the presence of SiCOH dielectric materials in the carrier fluid during the chemical mechanical planarazing process.

The detailed description explains the preferred embodiments of the invention, together with advantages and features, by way of example with reference to the drawings.

DETAILED DESCRIPTION OF THE INVENTION

The present invention generally relates to detection and characterization of dielectric materials during device fabrication, the dielectric materials comprising Si, C, O and H atoms (SiCOH) that have a low or ultra low dielectric constant (k). The SiCOH dielectric materials (porous or non-porous) generally comprise a matrix of a hydrogenated oxidized silicon carbon material (SiCOH) in a covalently bonded tri-dimensional network having a dielectric constant of about 2.8 or less. The term "tri-dimensional network" is used throughout the present application to denotea SiCOH dielectric materials that include silicon, carbon, oxygen and hydrogen that are interconnected and interrelated in the x, y, and z directions. It is noted that the dielectric materials are not intended to be limited to any particular composition or form, but instead comprises a random tri-dimensional (i.e., three dimensional) structure comprising a covalently bonded network. The covalently bonded network can comprise Si—O, Si—C, Si—H, C—H or C—C bonds.

The SiCOH dielectric material generally comprises between about 5 and about 40, more preferably from about 10 to about 20, atomic percent of Si; between about 5 and about 45, more preferably from about 10 to about 30, atomic percent of C; between 0 and about 50, more preferably from about 10 to about 35, atomic percent of O; and between about 10 and about 55, more preferably from about 20 to about 45, atomic percent of H.

In some embodiments, the SiCOH dielectric material may further comprise F and N. In yet another embodiment, the SiCOH dielectric material may optionally have the Si atoms partially substituted by Ge atoms. The amount of these optional elements that may be present in the dielectric material is dependent on the amount of precursor that contains the optional elements that is used during deposition.

The detection and characterization process disclosed herein monitors the hydrophobic nature of the SiCOH dielectric material. Specifically, the method detects and characterizes the existence of hydrophobic ligands such as Si—CH, $SiCH_2$, $SiCH_3$ quantitatively using chromatography and compares the concentration with that of siloxyl (Si—O) or silanol (SiOH) groups. The origin of the hydrophobicity results from carbon-containing ligands while the silanol groups in the backbone form the hydrophilic section of the dielectric material. The gradual replacement and termination of silanol groups (Si—O or SiOH) with hydrocarbons (Si—CH, $SiCH_2$, Si—$CH_3$, for example), disrupts the long range order of the original $SIO_4$ tetrahedral structure of the oxide network, leaving porosity in the structure. Also, the presence of the hydrocarbons increases the hydrophobicity. As such, detection and determination of the concentration of hydrocarbons present in the SiCOH dielectric material can be used to determine the hydrophobicity and porosity.

By way of example, reference to the detection and characterization process will now be in reference to an endpoint detection process employed during chemical mechanical polishing (CMP). CMP is commonly implemented during device fabrication to periodically planarize the surface of the device. The CMP apparatus employs a polish platen to apply a slurry that has been optimized to planarize the surface with minimal damage to the underlying structures. CMP takes advantages of the synergetic effect of both physical and chemical forces for polishing of wafers. Applying a load force to the back of a wafer while it rests on the platen does this. Both the platen and wafer are then counter rotated while the slurry containing both abrasives and reactive chemicals is passed underneath. As noted above, prior art methods are generally non-existent or ineffective for endpoint detection due to the similarities of other commonly employed oxide materials. In the present disclosure, a sampling port is embedded into the platen proximate to and downstream of the wafer to provide a means for periodic sampling of the CMP byproducts to a chromatographer.

Chromatography is an analytic technique used to separate and characterize mixtures. A typical chromatography process generally includes passing a sample, i.e., a mixture that contains an analyte in a mobile phase (also referred to as a carrier fluid), through a stationary phase. The stationary phase, typically a column packed with a porous immobile material, is configured to retard the passage of different components of the sample mixture at different rates. The mobile phase runs through the column and is adsorbed onto the stationary phase. The column can either be a packed bed or open tubular column. The result is a time base separation of the different components in the mixture. A detector analyzes the emerging stream by measuring a property, which is related to concentration and is characteristic of chemical composition. For example, the refractive index or ultra-violet absorbance is measured. The chromatographic apparatus can be integrated with various detectors, e.g., a mass spectrometer, UV spectrophotometer, and the like, so as to characterize and identify each fraction that is separated by the chromatographic apparatus.

In the present disclosure, the analyte, i.e., the substance to be detected, is the SiCOH material itself that is dissolved in the liquid phase as in the waste stream from the CMP process or that of a wet etch tank. Thus, the present disclosure is directed to device fabrication process steps that generate a liquid waste stream containing the SiCOH dielectric material and derivatives thereof. As such, the liquid stream could contain the hydrophobic ligands of the SiCOH material as the device fabrication process encounters the SiCOH dielectric material containing layer(s) of the device, e.g., $SiCH_x$, $CH_x$ and other hydrophobic derivatives, wherein x is an integer from 1 to 4. The stationary phase is configured to retain the different hydrophobic ligands at different rates. For example, the stationary phase can be silica that has been treated with $RMe_2SiCl$, where R is a straight chain alkyl group such as $C_{18}H_{37}$ or $C_8H_{17}$. The particular stationary phase is not intended to be limited, the selection of which is well within the skill of those in the art and generally depends on the particular SiCOH material used, the liquid stream, processing temperature, and the like.

As noted above the stationary phase retards the passage of analytes (solutes) of the sample. When the analytes pass through the system at different rates they become separated in time. Each component (e.g., $CH_x$) has a characteristic time of passage through the system, which is commonly referred to as the retention time. Chromatographic separation is achieved when the retention time of the analyte differs from that of other components in the sample. The degree of hydrophobicity of the sample can be determined by quantifying the retention time. As noted above, the chromatography equipment can be integrated to the particular processing tool, e.g. a CMP platform so as to provide an indication of endpoint. Alternatively, the chromatographic equipment can be a stand-alone too used for thin film characterization.

The FIGURE illustrates an exemplary chromatographic apparatus 10 having a sampling port 12 integrated into a polish platen 14 so as to provide the capability of detection and characterization of the SiCOH film during CMP. The sampling port 12 is in fluid communication with a stationary phase 16 of a chromatography apparatus, which is coupled to a detector 18 for analyzing and characterizing each component as it is eluted from the stationary phase. As previously noted, the platen and wafer are then counter rotated as indicted by arrows 24, 26, respectively, while the slurry containing both abrasives and reactive chemicals is passed underneath. The slurry is introduced via conduit 22 The detection window is disposed downstream from and proximate to the substrate 20 such that detection window is exposed to the slurry and CMP byproducts as the platen 14 rotates.

In an alternative embodiment, the concentration of hydrophobic ligands can be quantitatively monitored within a fixed time frame and applied to a hydrophobicity scale that is unique to the particular type of SiCOH material used in the manufacture of the device. The detected hydrocarbon/silanol concentration ratio is correlated with the hydrophobicity and porosity of the SiCOH material such that a hydrophobicity scale is generated, e.g., a scale from 1 to 10 with 10 being the most hydrophobic and porous. In this manner, the SiCOH material can be characterized and categorized.

While the preferred embodiment to the invention has been described, it will be understood that those skilled in the art, both now and in the future, may make various improvements and enhancements which fall within the scope of the claims which follow. These claims should be construed to maintain the proper protection for the invention first described.

What is claimed is:

1. A process for detecting and characterizing the presence of a SiCOH dielectric material in a fluid stream, the process comprising:

exposing a partially fabricated integrated circuit to a fluid stream, wherein the partially fabricated integrated circuit device comprises the SiCOH dielectric material; and chromatographically analyzing the fluid stream for the SiCOH material and hydrophobic derivates thereof, wherein chromatographically analyzing the fluid stream comprises flowing the fluid stream through a stationary phase, wherein the stationary phase is silica treated with $R(CH_3)_2SiCl$, wherein R is a straight chain alkyl group.

2. The process of claim 1, wherein the fluid stream is a slurry applied during a chemical mechanical planarization step.

3. The process of claim 1, wherein the fluid stream is a waste fluid from a wet strip process.

4. The process of claim 1, wherein chromatographically analyzing the fluid stream comprises detecting a hydrocarbon to silanol ratio and correlating the ratio to hydrophobicity and/or porosity of the SiCOH dielectric material.

5. The process of claim 2, wherein chromatographically analyzing the fluid stream comprises integrating a sample port into a platen of a chemical mechanical polishing apparatus.

6. The process of claim 1, wherein the fluid stream is a liquid.

7. The process of claim 1, wherein chromatographically analyzing the fluid stream determines an endpoint of a chemical mechanical planarization process or a wet stripping process.

8. The process of claim 1, wherein chromatographically analyzing the fluid stream comprises quantifying retention times for one or more components in the fluid stream.

* * * * *